United States Patent [19]

Jarreby

[11] Patent Number: 4,716,646

[45] Date of Patent: Jan. 5, 1988

[54] APPARATUS FOR AUTOMATIZED HANDLING OF TUBULAR SLEEVES

[75] Inventor: Karl A. B. Jarreby, Falkenberg, Sweden

[73] Assignee: Skandinaviska Apparatindustri AB Saiap, Falkenberg, Sweden

[21] Appl. No.: 940,563

[22] Filed: Dec. 12, 1986

[30] Foreign Application Priority Data

Dec. 20, 1985 [SE] Sweden ..... 8503125

[51] Int. Cl.[4] ..... B23Q 7/08; B65G 25/00

[52] U.S. Cl. ..... 29/564.1; 198/777; 414/748

[58] Field of Search ..... 29/564, 33 K, 33 P, 29/33 T, 563, 564.1; 414/748; 198/777, 345

[56] References Cited

U.S. PATENT DOCUMENTS

| | | | |
|---|---|---|---|
| 3,072,267 | 1/1963 | Gasparetti et al. | 414/748 |
| 3,090,499 | 5/1963 | Hieber et al. | 414/748 |
| 3,270,864 | 9/1966 | Kay | 198/777 |
| 3,592,335 | 7/1971 | Meyer | 198/777 |
| 3,864,816 | 2/1975 | Brusch | 29/563 |
| 4,038,861 | 8/1977 | Hartkopf et al. | 414/748 |
| 4,361,223 | 11/1982 | Johnson | 198/777 |

*Primary Examiner*—William R. Briggs

*Attorney, Agent, or Firm*—Harness, Dickey & Pierce

[57] ABSTRACT

An apparatus for automatic treatment and machining of tubular sleeves. The apparatus comprises a number of stations in which various kinds of treatments and machining operations are performed. Each station comprises a clamping means in which the tubular sleeve rests while the treatment or machining operation associated with that station is being performed. Each station also comprises a movable carriage designed to adapt the station to tubular sleeves of various lengths.

At each end of the tubular sleeve the stations are provided with one pivotable arm each, designed to lift the tubular sleeve away from the clamping means and advance it in a controlled manner to the next station. The stations are equipped with tools designed to treat and machine the tubular sleeve. One of the tools is movably mounted on the carriage.

5 Claims, 4 Drawing Figures

APPARATUS FOR AUTOMATIZED HANDLING OF TUBULAR SLEEVES

BACKGROUND OF THE INVENTION

The subject matter concerns an apparatus which is designed for automatized handling of tubular sleeves of the kind which are intended to be used as the core sleeves for paper webs in the manufacture of paper. The apparatus comprises a number of operational stations equipped with tools of various kinds to subject the tubular sleeves to various working operations. The stations all comprise holder elements to retain the tubular sleeve in position while it is being subjected to the machining operation of that particular station. These tubular sleeves are intended to be used as the paper web winding-on cores in the manufacture of paper.

In paper mills the finished paper is wound onto core sleeves. These are made from tubular sleeves of cardboard which are cut to the desired lengths, whereupon they are machined, provided with metal sleeves and, when desired, also provided with end plugs. All these working operations are effected while using conventional techniques which are not automatized and require considerable manual operations. For instance, all handling and transfer of the tubular sleeves during and between the separate working operations are carried out manually. This makes the handling and the machining operations on the tubular sleeves work-consuming and difficult to arrange in a efficient and well organized manner.

In order to achieve good economy in industrial production processes it is essential that the various part processes of the production are well coordinated. This requires reliable control of the part processes. When this is achieved it becomes possible to obtain an efficient flow of materials and products in production.

SUMMARY OF THE INVENTION

The purpose of the subject invention is to provide an apparatus by means of which the machining and handling operations of tubular sleeves in the paper production may be controlled and effected in an efficient and automatized manner. In addition, the sleeve machining steps may be integrated into the paper manufacture control functions and be coordinated therewith. The apparatus in accordance with the invention also comprises at least one actuating means at each machining or handling station, arranged to release the sleeve from the holder means and move it from the station. The apparatus is characterized in that each station is equipped with at least one carriage which is arranged to be displaced in the lengthwise direction of the station for setting the spacing between the sleeve holder means for adjustment of said spacing to the length of the tubular sleeve to be treated, and in that the means which is arranged to release and move said tubular sleeve from said holder means consists of at least one pivotally mounted arm which is arranged to be pivoted between an upper and a lower position, so that in the upper position said arm lifts the tubular sleeve off the holder means and forms a guide means to guide the tubular sleeve from the station.

Further characteristics of the invention will appear from the dependent claims.

BRIEF DESCRIPTION OF THE DRAWINGS

The invention will be described in closer detail in the following with reference to the accompanying drawings, wherein.

DETAILED DESCRIPTION OF A PREFERRED EMBODIMENT

The apparatus in accordance with the invention is intended to subject tubular sleeves 10 to various machining or working operations. The sleeves 10 are discharged one by one from a supply crate 12 up to a feeder 14 which advances the tubular sleeves up to an automatized cross-cutting saw 16. All these components 10–16 are of conventional type. The cross-cutting saw 16 severs the tubular sleeves to the desired predetermined length for which the saw is set.

The cut tubular sleeves 10 are advanced from the cross-cutting saw 16 to the first one of the stations incorporated in the apparatus. In the illustrated embodiment of the invention the apparatus comprises four operational stations. The number of stations in the apparatuses is chosen in dependency of the machining or handling operations that are desired.

Figure 2:
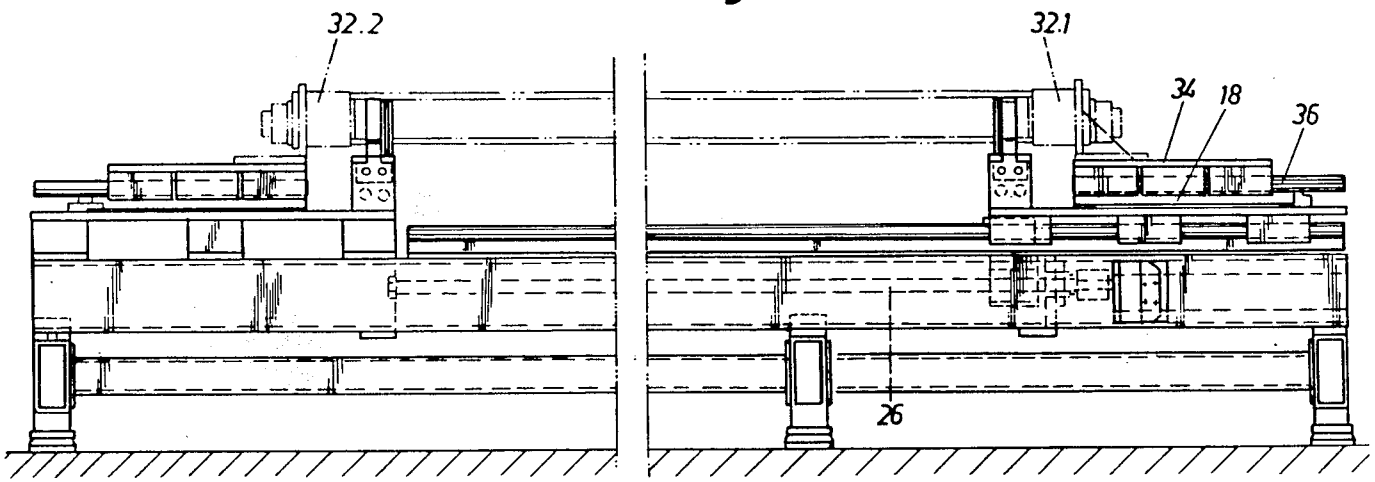
FIG. 2 is a lateral view of a detail incorporated in one of the stations forming part of the apparatus in accordance with the invention.
Figure 3:
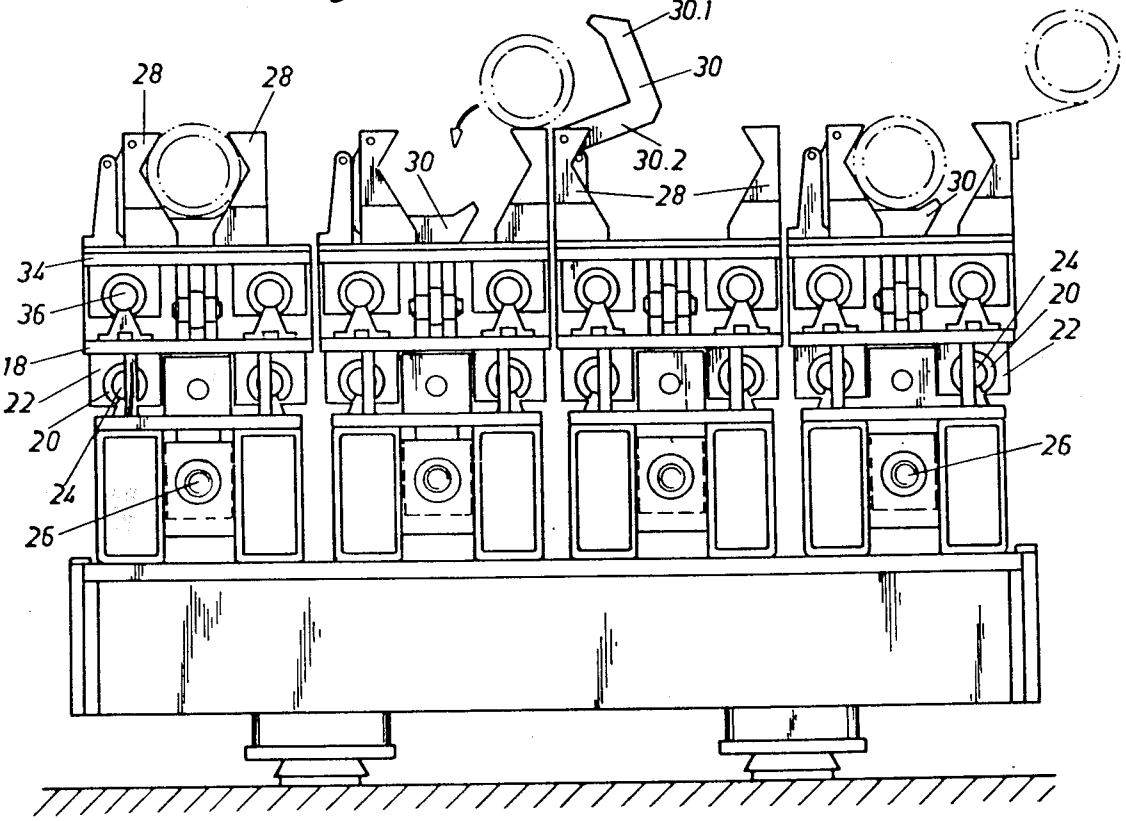
FIG. 3 is a cross-sectional view along line III—III of FIG. 2.

FIGS. 2 and 3 show a part of one machining or handling station. The station comprises a movable carriage 18. On the lower face the carriage 18 is provided with a number of spherical bushings 20 enclosed in retainer cages 22. The spherical bushings 20 are mounted on rails 24 which extend in the lengthwise direction of the station (and of the tubular sleeve 10). The movable carriage 18 may be actuated for displacement along the rails 24 with the aid of a spherical screw 26. By turning the spherical screw 26 the carriage 18 may be moved to the desired position for adaptation of the station to severed tubular sleeves 10 of different lengths.

The carriage 18 is provided with clamping jaws 28 (see FIG. 3). The jaws are movable horizontally towards each other to grip between them the end of the tubular sleeve 10 in the manner illustrated in the left-hand station in FIG. 3. This movement is preferably achieved by arranging one or both clamping jaws 28 in such a manner that they can move in grooves or along sliding rails and be hydraulically operated. Each station comprises an angled arm 30 which is pivotally mounted in the left clamping jaw (in accordance with FIG. 3) of the station and which may be operated by hydraulic or equivalent means from a lower position in which the outer extremity 30.1 of the angled arm catches the tubular sleeve 10 and an upper position wherein the arm lifts the tubular sleeve 10 and the latter is transferred to the next station while being guided by the inner part 30.2 of the angled arm.

The tubular sleeves 10 are handled in the manner shown in FIG. 3. After having been cut to the desired length the tubular sleeve 10 is allowed to fall down into the first station (right-hand) wherein it is supported on the arm 30 between the clamping jaws 28. The jaws are moved towards each other to clampingly retain the sleeve 10 between them and the ends of the tubular sleeve are subjected to the first treatment or machining operation. The clamping jaws 28 are then moved apart and the arm 30 is pivoted to lift the tubular sleeve across the jaws 28 and transfer it to the following station (cf. stations 2 and 3 in FIG. 3). FIG. 3 shows only the movable set of stations (right-hand station in FIG. 2) but the steps of handling and actuating the end of the tubular sleeve 10 are effected in the same manner in the fixed set of stations.

The individual stations comprise tool holder means 32 on which the tools required to perform the various machining operations on the cut tubular sleeve 10 are mounted. A movable tool holder means 32.1 is mounted adjacent the carriage 18. This movable tool holder means preferably has a counterpart in the form of a fixed tool holder means 32.2 mounted in front of the opposite end of the tubular sleeve 10. The tool holder means 32.1 is arranged for movement towards and away from the opening of the tubular sleeve that is being retained in the station for the purpose of performing a treatment or machining operation on said opening or to mount a metal sleeve thereon or to apply a plug in said opening.

The tool holder means 32 is designed so as to allow various kinds of tools to be mounted thereon, such as tools for polishing the end face of the tubular sleeve by heating the inner rim of the opening a die to make a groove at the end of the tubular sleeve, a tool for mounting a metal sleeve in the tube, a tool having a bushing comprising a number of balls which are arranged to be forced outwards by means of a conically shaped insert in the bushing so as to press the wall of the metal sleeve part introduced inside the tubular sleeve 10 radially outwards for attachment of the metal sleeve, or a tool designed to apply a plug in the opening in the tubular sleeve or the metal sleeve. Each station is equipped with the desired set of tools. All tools are of a conventional prior-art type. The artisan can easily adapt the tools to allow them to be mounted on the tool holder means 32.

Figure 1:
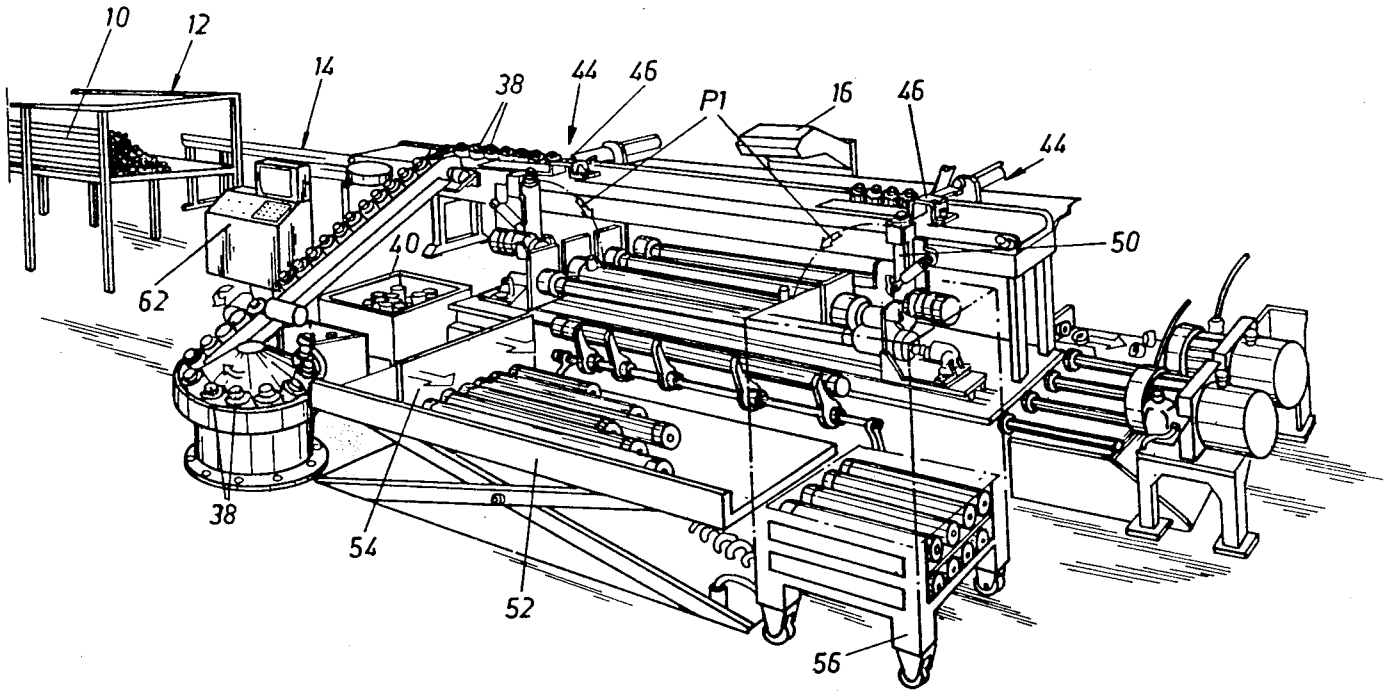
FIG. 1 is an overall general perspective view of an apparatus in accordance with the invention.
Figure 4:
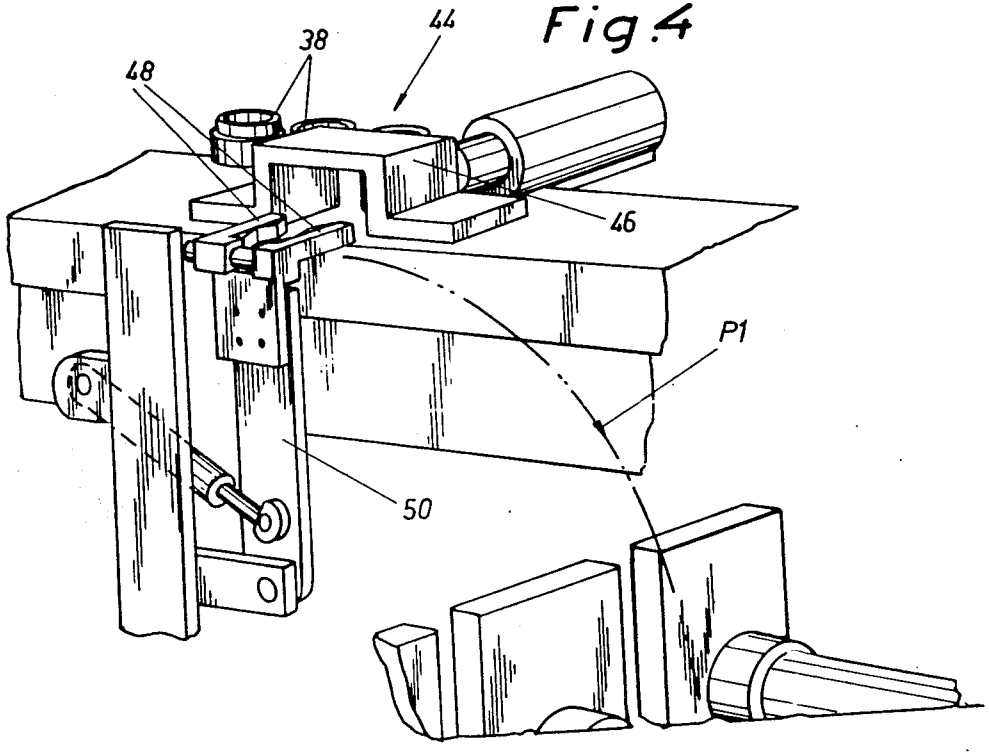
FIG. 4 is a detail view on a larger scale of a detail incorporated in the apparatus.

Each tool holder means 32.1 is mounted on its individual carriage 34 which is arranged for movement along rails 36 provided on the upper face of the carriage 18. By means of this carriage, the tools may be inserted into the tubular sleeve 10 to perform the desired machining operations. Plugs 38 intended to be applied in the ends of the tubular sleeves 10 are stored in a box 40. By vibrating the box the plugs are discharged one by one onto a feeder belt 42 up to two pick-out stations 44 which preferably are positioned above the stations for treatment of the tubular sleeves 10 (cf. FIG. 1). In the pick-out stations 44 the plugs 38 are pushed one by one through a yoke gate 46 and are inserted into the space between two gripping means in the form of clamping jaws 48 (see FIG. 4) which are mounted on an arm 50. The arms 50 are pivoted over a quarter of a turn, cf. arrows P1 in FIG. 1, to positions wherein the plugs 38 are opposite and on either side of the end openings of the tubular sleeve 10. Tools mounted on the tool holder means 42 of the station concerned engage the plugs 38 and move them out of the gripping means and into the end openings of the tubular sleeves 10. The finished tubular sleeves 10 are lifted off the last treatment station and are carried to an elevator table 52 of a type known per se on which they are collected before being transported further along the line, for instance on a moving plate 54 up to a carriage 56 or the like.

All steps of the tubular sleeve machining and handling process in the apparatus in accordance with the invention are controlled automatically from a central control unit (control board) 62. This unit is used to set and control operational steps such as setting the desired cutting length of the tubular sleeves 10, and moving the carriages 18 to the positions that correspond to the length of the cut tubular sleeves 10. Also the operational steps of machining the tubular sleeves are controlled by the unit 62. This makes the control function an easy one and in addition the tubular sleeve machining and handling operations are easily organizable and therefore it becomes easy to integrate the operation and action of the apparatus in accordance with the invention with the production of paper in the mill. Adjustment and resetting of the apparatus to handle and machine tubular sleeves 10 of different lengths may be carried out rapidly.

The embodiment of the invention described in the aforegoing is to be regarded as one example only and a variety of different embodiments are possible within the scope of the appended claims. Other types of tools than those described may be used to handle and treat the tubular sleeves, to suit other types of operational steps that may be desirable. The spherical screw 26 may be replaced by a positioning cylinder. It is possible to arrange for all stations to be movable. To actuate the carriage 18 the spherical screw 26 may be divided into two parts having oppositely threaded screw paths, so that when the spherical screw is being turned the carriages are moved symmetrically towards or away from each other. It is likewise possible to arrange for each station to work on only one end of the tubular sleeve, in which case each station comprises one tool only and a support or back-up means at the opposite end. The ends of the tubular sleeves are then machined alternately in the various stations.

What I claim is:

1. An improved apparatus for automatic treatment and machining of tubular sleeves of the kind which are used as the cores onto which are wound the paper web in the production of paper, said apparatus comprising a number of stations for performing various treatment and machining operations on said tubular sleeves, each station equipped with a tool adequate for performing the treatment or machining operation associated with said station, holder means in each station for retaining said tubular sleeve during the performance of said treatment or machining operation in the associated station, and at least one actuating means in each station to release said tubular sleeve from said holder means and move said sleeve away from said station, the improvement comprising at least one carriage in each station, said carriage arranged for displacement in the longitudinal direction of said station for setting the spacing between said holder means for adjustment of said spacing to the length of the tubular sleeve to be treated, and wherein said means arranged to release and move said tubular sleeve from said holder means consists of at least one pivotally mounted arm, said arm arranged to be pivoted between an upper and a lower position, so that in said upper position said arm lifts said tubular sleeve off said holder means and forms a guide means to guide said tubular sleeve from said station.

2. An improved apparatus as claimed in claim 1, comprising two carriages in each station, at least one of said carriages arranged for movement in the lengthwise direction of said station, an elongate screw to control said movement, and a pair of rails, said carriage movable along said pair of rails.

3. An improved apparatus as claimed in claim 1, comprising at least one pair of horizontally movable clamping jaws, said jaws arranged to retain said tubular sleeves by exerting a clamping force thereon while said treatment or machining operations are being performed in the associated one of said stations.

4. An improved apparatus as claimed in claim 1, wherein said pivotable arm is an angled arm having an outer extremity part designed to catch said tubular sleeve in the lower arm position, and an inner part designed to control the advancement of said tubular sleeve in the upper arm position.

5. An improved apparatus as claimed in claim 1, comprising means to advance plugs one by one up to a gripping means, said means provided on arms which are displaceable to move said plugs to their individual postions on either side of the end openings of said tubular sleeve, and tools arranged to insert said plugs inside said tubular sleeve.

* * * * *